US005708951A

United States Patent [19]

Saito et al.

[11] Patent Number: 5,708,951

[45] Date of Patent: Jan. 13, 1998

[54] TONER IMAGE FIXING DEVICE

[75] Inventors: Hideo Saito; Kazumi Inaba; Hideaki Sekiguchi; Keitaro Sonoguchi, all of Ebina, Japan

[73] Assignee: Fuji Xerox Co., Ltd., Tokyo, Japan

[21] Appl. No.: 732,878

[22] Filed: Oct. 16, 1996

[30] Foreign Application Priority Data

Oct. 18, 1995 [JP] Japan ..... 7-293803

[51] Int. Cl.[6] ..... G03G 15/20

[52] U.S. Cl. ..... 399/333

[58] Field of Search ..... 399/328, 330, 399/331, 333; 219/216

[56] References Cited

U.S. PATENT DOCUMENTS

| | | | |
|---|---|---|---|
| 3,912,901 | 10/1975 | Strella et al. . | |
| 4,149,797 | 4/1979 | Imperial . | |
| 4,814,819 | 3/1989 | Torino et al. | 399/331 |
| 5,345,301 | 9/1994 | Satoh et al. | 399/330 |
| 5,530,536 | 6/1996 | Henry et al. | 399/333 |

FOREIGN PATENT DOCUMENTS

| | | |
|---|---|---|
| 63-036283 | 2/1988 | Japan . |
| A63-259582 | 10/1988 | Japan . |
| 4-042183 | 2/1992 | Japan . |
| B22-77233 | 1/1995 | Japan . |

*Primary Examiner*—Robert Beatty
*Attorney, Agent, or Firm*—Oliff & Berridge

[57] ABSTRACT

A toner image fixing device which has a satisfactory self-stripping ability to suppress the formation of creases of an envelope, and to prevent the abrasion of the elastic layers of a pair of toner image fixing rollers. In the fixing device, surface strain $\epsilon h$ in the circumferential direction of the first elastic layer of a first toner image fixing roller which comes in contact with a non-fixed toner image on a recording medium, and surface strain $\epsilon p$ in the circumferential direction of the second elastic layer of a second toner image fixing roller are defined by:

$$\epsilon h \cong 0.0583\,(\Delta\epsilon)^4 - 0.6\,(\Delta\epsilon)^3 + 2.1917(\Delta\epsilon)^2 - 3.65(\Delta\epsilon) + 6$$

where $\epsilon h < 6\%$, $\Delta\epsilon \leqq 3\%$ and $\Delta\epsilon = \epsilon h - \epsilon p$.

1 Claim, 6 Drawing Sheets

TONER IMAGE FIXING DEVICE

BACKGROUND OF THE INVENTION

The present invention relates to a toner image fixing device of the type which fixes a toner image, not yet fixed, on a recording medium by heating the toner image and pressing it against the recording medium in an image information recording apparatus such as a copying machine, a facsimile machine, and a printer.

An example of a conventional toner image fixing device is shown in FIG. 5, in which a pair of fixing rollers (heating roller and a pressure roller) are provided in such a manner that the pressure roller is pressed against the heating roller. A recording paper with a toner image, not yet fixed, (referred to as a non-fixed toner image) is passed through an area where both the rollers are brought into contact with each other. At this area, the non-fixed toner image is heated and fixed onto the recording paper.

In FIG. 5, reference numeral 30 designates a heating roller, and 40, a pressure roller. The heating roller 30 is constructed such that a relatively thick elastic layer 32 made of silicone rubber, for example, is layered on the surface of a hollowed roller 31 made of metal of high thermal conductivity, for example, aluminum, and a halogen lamp 33 as a heating source is located in the hollowed roller 31. A temperature sensor, not shown, is provided on the surface of the heating roller 30. A signal generated by the sensor is applied to a temperature control circuit, not shown. Under control of the temperature control circuit, the halogen lamp 33 is turned on and off so that temperature of the heating roller 30 is controlled to a desired temperature. An oil supplying device, not shown, is provided for supplying a certain amount of silicone oil to the heating roller 30 in order to prevent an occurrence of phenomenon that part of a non-fixed toner 51 is transferred from the recording paper 50 to the heating roller 30 during the fixing process. This phenomenon will be referred to an offset.

The pressure roller 40 consists of a core roller 41 and a covering layer 42 made of Teflon (Trade Mark of Du Pont corporation), with which the surface of the core roller 41 is covered. With the paired fixing rollers 30 and 40, when the pressure roller 40 covered with the covering layer 42 is pressed against the heating roller 30 also covered with the elastic layer 32, the elastic layer 32 is elastically deformed to form a pressure area 35 between the paired rollers 30 and 40. The pressure area 35 is referred to as a nip. The recording paper 50 with the non-fixed toner 51 formed thereon is passed through the nip, so that the non-fixed toner 51 is heated and fixed onto the paper 50 under pressure.

The roller construction of the type in which the roller (heating roller) 30 that comes in contact with the non-fixed toner image is elastically deformed to form the nip 35, enables a thin and flexible recording paper 50 bearing a large amount of toner thereon to be stripped off not using any stripping means at the exit of the nip 35. This stripping motion will be referred to as a self-stripping. Accordingly, this type roller construction is used for satisfactorily fusing and fixing color toner images of three colors (cyan, magenta and yellow) on a recording paper 50 to have intended colors.

This is due to the fact that an adhesion at the interface between the molten toner and the surface of the heating roller 30 depends largely on a surface strain of the heating roller 30 caused by its elastic deformation, in addition to surface chemical, physical property values of the material. In a transitional shift of a surface state of the heating roller 30 from a state that the molten toner is in contact with the surface of the heating roller 30 previously strained in its surface to a state that the roller surface is instantaneously released from its strain, an adhesion acting between the toner and the surface of the heating roller 30 decreases.

In case where the surface of the heating roller 30 is covered with a layer of a material that is relatively easily deformed when it receives an external load, such as silicone rubber and fluororubber, the fixing operation of the toner image on the surface of the heating roller 30 progresses at the nip 35 while the roller surface is under strain. In this case, at instant that the roller surface is released from the strain at the exit of the nip 35, the adhesion acting between the toner and the roller surface abruptly decreases, and the discharging direction of the recording paper 50 is turned to the pressure roller 40 at the exit of the nip 35. This action of the recording paper possibly causes the self-stripping of the paper.

From this fact, it is seen that as a strain ($\in$) of the heating roller 30 is larger and the discharging direction of the recording paper 50 is more turned to the pressure roller 40, the self-stripping ability of the paper is more increased.

The roller construction shown in FIG. 5 suffers from the following problem. In the construction, no elastic deformation takes place in the pressure roller 40. Accordingly, as the load applied to the surface of the heating roller 30 increases, a difference between the peripheral velocity of the heating roller 30 and that of the pressure roller 40 is larger. Where the peripheral velocity difference is large, the abrasion of the elastic layer 32 rapidly progresses.

A proposal to solve the technical problem has been made in Published Unexamined Japanese Patent Application No. Sho. 63-25982, or example. In the publication, as shown in FIG. 6, a relatively thin elastic layer 43 which is thinner than the elastic layer 32 on the heating roller 30, is layered on the surface of the pressure roller 40. A surface strain that is smaller than in the heating roller 30 is generated also in the pressure roller 40.

In this roller construction, as the load increases, the quantities of the surface strain in both the rollers 30 and 40 are correspondingly increased. The peripheral speed difference between the rollers 30 and 40 is fixed at a predetermined value. Accordingly, the abrasion of the roller 30 is reduced and the nip 35 is broadened.

However, in the roller construction of FIG. 6, when the recording paper 50 is of an envelope, creases are easily formed on the envelope, although those are not formed on a normal paper.

The structure of the envelope is substantially equivalent to such a structure in which two sheets of recording papers are layered one on the other, and three corners of them are pasted. In the nip, the upper and lower papers are affected by the strain of the rollers in contact with these sheets. Accordingly, these papers are transported at different speeds. At this time, the shift of the papers one from the other is blocked by the pasted portions, so that creases are formed on the papers. Incidentally, if those layered papers are not pasted at the three corners, the creases will hardly be formed on the papers.

A solution to solve the technical problem is disclosed in Examined Japanese Patent Publication No. Hei. 7- 7233, for example. As shown in FIG. 7, to prevent the crease formation, the thickness of the elastic layer 32 of the heating roller 30 is set to be equal to that of the covering layer 42 of the pressure roller 40. By selecting so, the nip 35 is made substantially flat to equalize the quantities of strain of the rollers 30 and 40.

In the roller construction of FIG. 7, no action is made to turn the discharging direction of the recording paper 50 to the pressure roller 40 at the exit of the nip 35. Accordingly, the discharging operation of the recording paper 50 is instable. The paper will hardly self-strip when the much-toner bearing, thin and flexible recording paper 50 is color developed. This necessitates the aid of a stripping pawl for the stripping-off of the paper.

The following technical problem arises also in handling the amount of used silicone oil as a release agent, supplied to the heating roller 30.

In the fixing device in which satisfactorily molten color images are fixed and then the paper is self-stripped, an oil layer must be formed in the interface between the molten toner and the surface of the heating roller 30, viz., in the nip. Accordingly, a great amount of silicone oil is supplied to the heating roller 30, so that much silicone oil adheres to the recording paper 50 after it undergoes the fixing process.

In this case, the oil sticking to the paper is unpleasant when a user touches the paper after the fixing process.

A test was conducted. In the test, the amount of silicone oil supplied from the oil supplying device to the roller 30 was reduced to such an extent that the user does not feel unpleasant when it touches the paper after the fixing process. The result was the necessity of generating a large strain in both the rollers 30 and 40. A technical problem, i.e., the abrasion of the elastic layers 32 and 42, arise anew as in the roller construction of FIG. 5.

As described above, it is very difficult to control the "self-stripping ability", "creases of the envelope" and "abrasion of the elastic layers" within their tolerances since the surface strain ($\in h$) of the heating roller 30, the surface strain ($\in p$) of the pressure roller 40 and the strain difference ($\in h - \in p$) intricately interact one another. For this reason, it is very difficult to construct the fixing device in which those factors fall within the required tolerances.

SUMMARY OF THE INVENTION

In view of the reasons describe above, the present invention has been made and has an object to provide a toner image fixing device which has a satisfactory self-stripping ability that enables a recording paper to automatically strip off at the exit of the nip without any aid of the stripping device when the much-toner bearing, thin and weak recording paper is color developed and fixed, suppresses the formation of creases of the envelope, and prevents the abrasion of the elastic layers of the fixing rollers.

The present inventors assume that the strain difference ($\in h - \in p$) between the paired fixing rollers is a major factor to determine the formation of creases in the envelope, that the surface strain $\in h$ of the fixing roller, which comes in contact with the non-fixed toner image, in the circumferential direction and the discharging direction of the recording medium at the exit of the nip are major factors to determine the self-stripping ability, and that the surface strain $\in h$ of the fixing roller, which comes in contact with the non-fixed toner image, in the circumferential direction, or a difference between the strain $\in h$ in the circumferential direction at the middle and the strain $\in h$ at the ends of the fixing roller is a major factor to determine the abrasion of the fixing rollers. The inventors succeeded in empirically specifying the tolerances for the "creases of the envelope", "self-stripping ability", and "abrasion of the elastic layer". The present invention has been made on the basis of the estimations and the specified tolerances.

The above and other objects of the present invention are met by the provision of a toner image fixing device comprising first and second toner image fixing rollers rotatable to each other in a state that the rollers are pressed each other; and a heating source contained in one of the fixing rollers; the surfaces of the first and second fixing rollers being covered with elastic layers, respectively, and a recording medium bearing a non-fixed toner image being passed through a nip between the first and second rollers to thereby fix the non-fixed toner image on said recording medium, wherein surface strain $\in h$ in the circumferential direction of the elastic layer of the first roller which comes in contact with the non-fixed toner image on the recording medium, and surface strain $\in p$ in the circumferential direction of the elastic layer of the second fixing roller are defined by:

$$\in h \geqq 0.0583\,(\Delta\in)^4 - 0.6\,(\Delta\in)^3 + 2.1917(\Delta\in)^2 - 3.65(\Delta\in) + 6$$

where $\in h < 6\%$, $\Delta\in \leqq 3\%$ and $\Delta\in = \in h - \in p$.

BRIEF DESCRIPTION OF THE INVENTION

Figure 4:
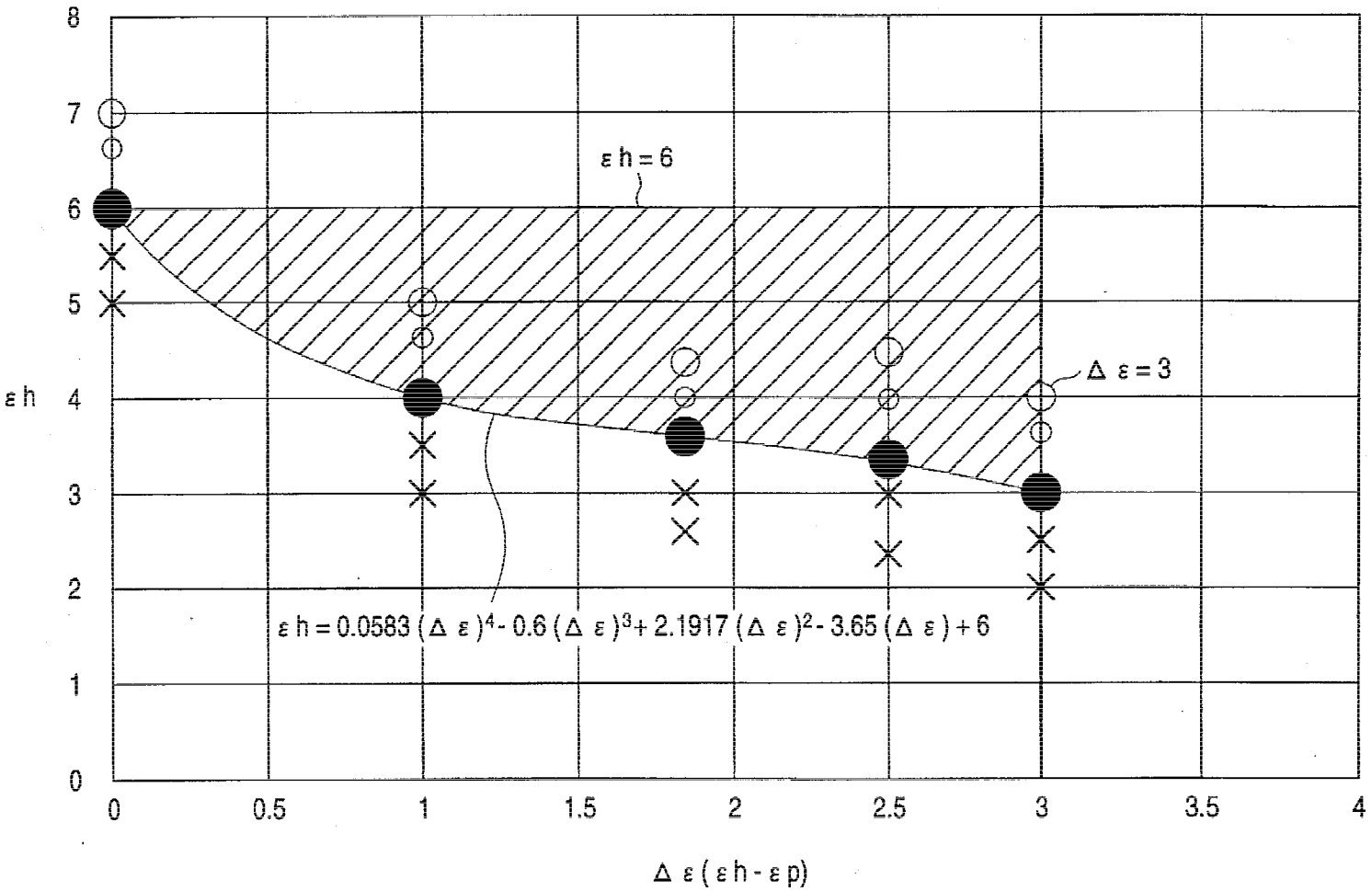
Figure 5:
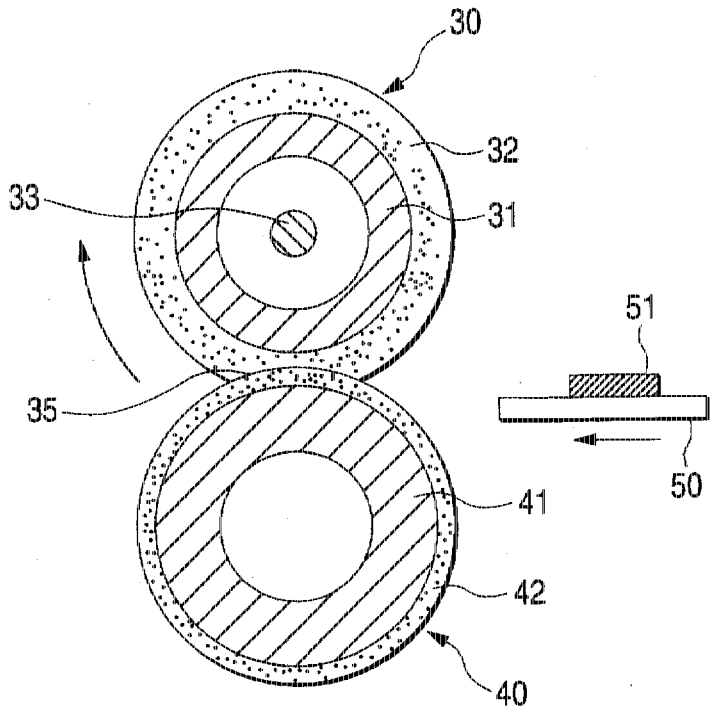
FIG. 5 PRIOR ART
Figure 6:
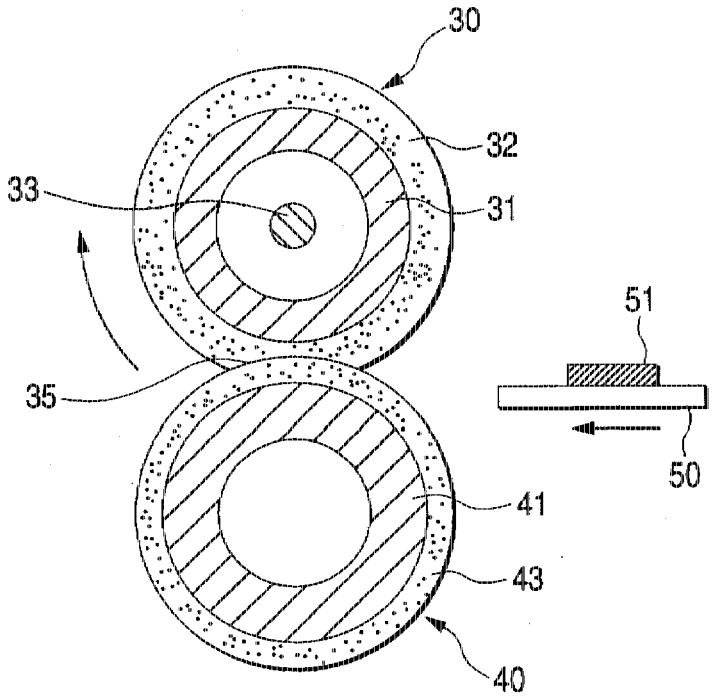
FIG. 6 PRIOR ART
Figure 7:
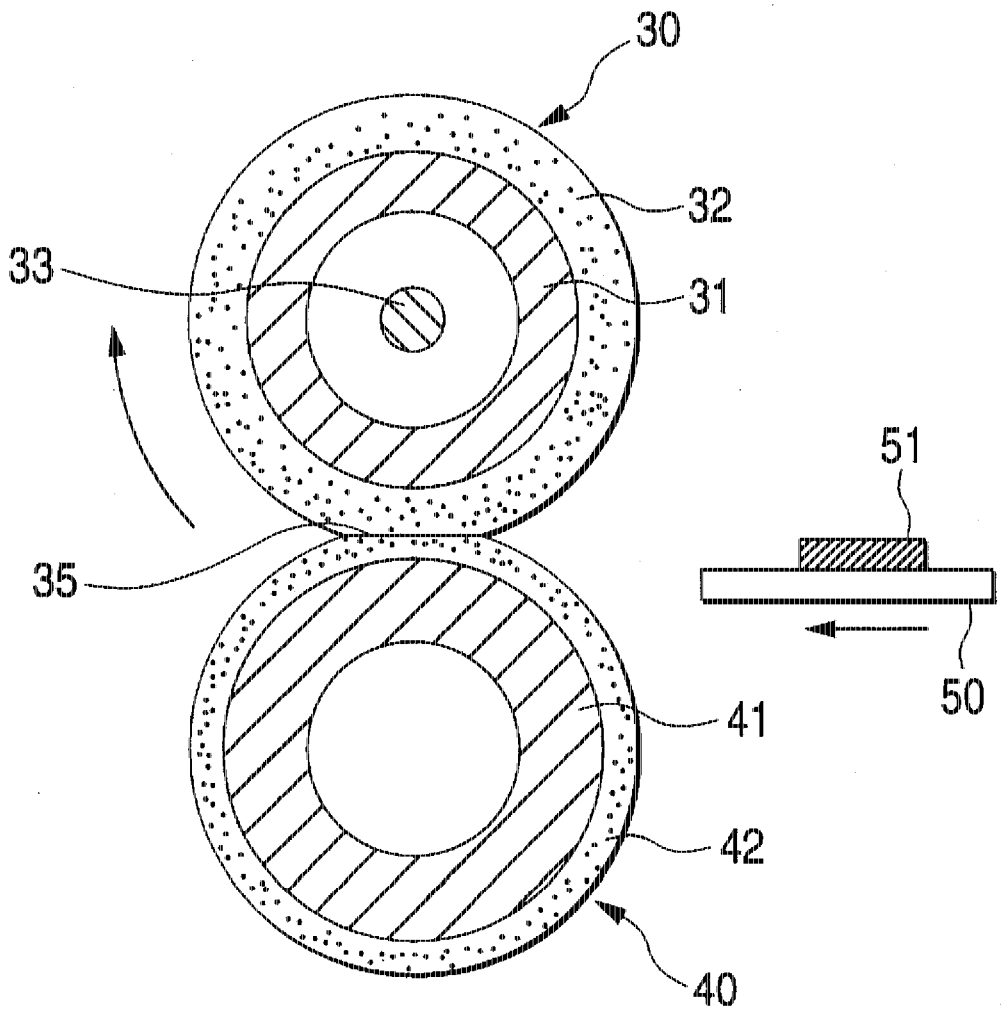
FIG. 7 PRIOR ART

FIGS. 3*a* to 3*d* are explanatory diagrams each showing the feeding of an envelope to a pair of fixing rollers when viewed from the pressure roller of the fixing rollers;

FIG. 4 is a graph showing a variation of a strain characteristic ($\Delta\in(\in h - \in p)$) of the fixing device according to the present invention;

FIG. 5 is an explanatory diagram for explaining an example of the conventional fixing device;

FIG. 6 is an explanatory diagram for explaining another example of the conventional fixing device; and FIG. 7 is an explanatory diagram for explaining yet another example of the conventional fixing device.

DESCRIPTION OF THE PREFERRED EMBODIMENTS

The preferred embodiment of the present invention will be described with reference to the accompanying drawings.

Figure 1:
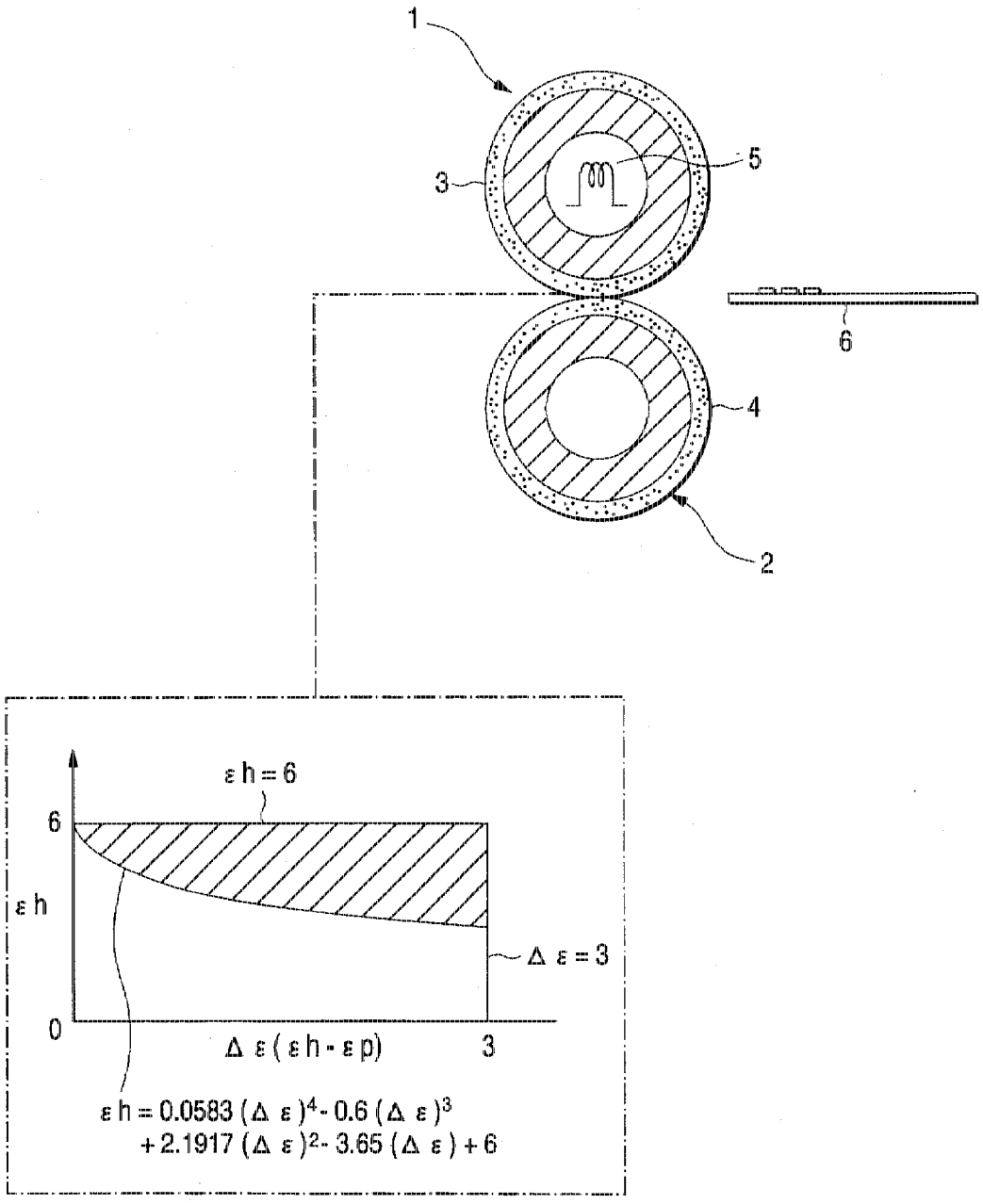
FIG. 1 is an explanatory diagram showing a scheme of a fixing device according to the present invention.
Figure 2:
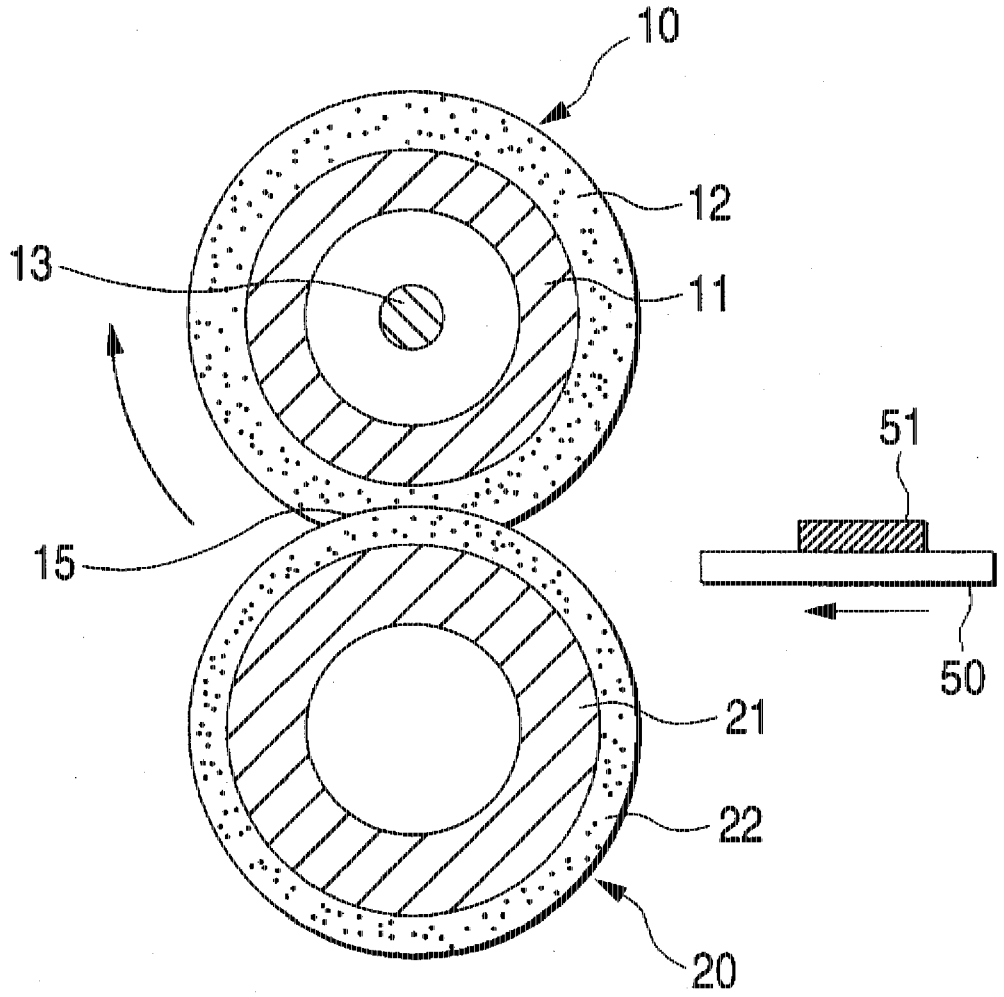
FIG. 2 is an explanatory diagram showing an embodiment of a fixing device according to the present invention.

FIG. 2 is an explanatory diagram showing an embodiment of a fixing device according to the present invention.

In the figure, the fixing device includes a heating roller 10 and a pressure roller 20, which are rotatable in a state that those rollers are pressed one against the other, viz., the pressure roller 20 is pressed against the heating roller 10. A recording paper 50 having a non-fixed toner image formed thereon is passed through the pressed part (nip) between the rollers 10 and 20, to thereby fix the non-fixed toner image on the paper.

In the present embodiment, the heating roller 10 includes a hollowed roller 11 as an iron cylindrical member, and an elastic layer 12 of 2 mm thick layered on the surface of the hollowed roller 11. The outside diameter of the hollowed roller 11 is 32 mm, and the inside diameter thereof is 28 mm. The elastic layer 12 is formed with an HTV silicone rubber (40° in rubber hardness) as a primary coat and a fluororubber (60° in rubber hardness) of 30 μm thick dip-coated over the surface of the silicone rubber. The surface of the elastic layer 12 is finished to be on a level with a mirror surface. A halogen lamp 13 of 500 W as a heating source is provided in the hollowed roller 11. Temperature of the surface of the heating roller 10 is controlled to be within a range of 145°

C. to 155° C. by a temperature controller, not shown, when it receives a signal from a temperature sensor, not shown.

Amino modified silicone oil (oil viscosity: 300 CS) with—(CH2)2NH2 as the functional group (b=0.1, c=1, and 30(X-21-7763G), manufactured by Shinetsu Kagaku corporation in Japan, is used for a release agent. The silicone oil is uniformly supplied to the recording paper 50 at the rate of 3 mg per area of A4 size by an oil supplying system.

Additionally, a cleaning web (not shown) using unwoven fabric, as cleaning means, is provided on the surface of the heating roller 10.

The pressure roller 20 includes a hollowed roller 21 as an iron cylindrical member, and an elastic layer 22 of A mm thick layered on the surface of the hollowed roller 21. The outside diameter of the hollowed roller 21 is 32 mm, and the inside diameter thereof is 28 mm. The elastic layer 22 is formed with an HTV silicone rubber (40° in rubber hardness) as a primary coat and a fluororubber (60° in rubber hardness) of 30 μm thick dip-coated over the surface of the silicone rubber. The surface of the elastic layer 22 is finished to be on a level with a mirror surface.

An experiment was conducted for examining the strain characteristic of the present embodiment. In the experiment, the thickness of the elastic layer 22 was set at seven levels: 0.25 mm, 0.5 mm, 0.75 mm, 1.0 mm, 1.25 mm, 1.5 mm, and 2.0 mm. The hollowed roller 21 as an iron cylindrical member, the outside diameter of which is 32 mm and the inside diameter thereof is 28 mm, and the surface is coated with Teflon (Trade Mark of Du Pont corporation) was used as an additional level.

The pressure roller 20 is urged toward the center of the heating roller 10 by a compressed coiled spring (not shown) as a pressure means so that the surface strain of the heating roller 10 is 4%. In this case, the load and the nip width are determined by the level Of the pressure roller 20. Specifically, the load was within the range of 30 to 40 kg, and the nip width ranged from 3.5 to 5.5 mm. The heating roller 10 was turned at 70 mm/sec by means of drive means (not shown) using a belt, and the pressure roller 20 was turned following the heating roller 10. The surface temperature of the heating roller 10 was determined depending on the levels of the pressure roller 20 in order to match the fixing/color developing levels.

Some kinds of envelops were passed through the fixing device thus constructed, and creases formed on the envelopes were examined. The envelopes used were: Monroe Brand size 10, Monroe Brand size Monarch, River Series size 110×220 mm, and River Series size 162×229 mm.

TABLE 1

| | | Depression Nip | | | | | | |
|---|---|---|---|---|---|---|---|---|
| | Flat Nip | 1 | 2 | 3 | 4 | 5 | 6 | 7 |
| Elastic Layer Thickness of Heating Roller (mm) | 2 | 2 | 2 | 2 | 2 | 2 | 2 | 2 |
| Elastic Layer Thickness of Pressure Roller (mm) | 2 | 1.5 | 1.25 | 1.0 | 0.75 | 0.5 | 0.25 | 0 |
| $\epsilon h$ (%) | 4 | 4 | 4 | 4 | 4 | 4 | 4 | 4 |
| $\epsilon p$ (%) | 4 | 3 | 2.5 | 2 | 1.5 | 1 | 0.5 | 0 |
| $\Delta\epsilon$ ($\epsilon h - \epsilon p$) | 0 | 1 | 1.5 | 2 | 2.5 | 3 | 3.5 | 4 |
| Creases upon Feeding in Horizontal Direction | ◎ | ◎ | ◎ | ○ | ○ | ○ | Δ | Δ |
| Creases upon Feeding in Vertical Direction | ◎ | ○ | ○ | ○ | Δ | Δ | X | XX |

In Table 1, the roller construction (including the pressure roller covered with a Teflon layer) for the flat nip corresponded to the conventional one shown in FIG. 7. The depression nip of the heating roller were classified on the basis of the thickness (rubber thickness) of the elastic layer of the pressure roller 20.

In Table 1, "horizontal feed" means the feeding of the envelope in the direction as shown in FIGS. 3(*c*) or 3(*d*). "Vertical feed" means the feeding of the envelope in the direction as shown in FIGS. 3*a* or 3*b*. In FIGS. 3*b* and 3*d*, the flap 52*a* of the envelope 52 is left open.

In the table, the marks indicating the evaluation results have the following meanings.

(double circle): "No creases were formed";

O: Creases of 5 mm or shorter appear on some of the envelops;

A: Creases of 10 mm or shorter appear on all of the envelopes;

X: Creases of 30 mm or shorter appear on all of the envelopes; and

XX: Creases of 30 mm or longer appear on all of the envelopes.

When names and addresses are copied on the envelope by using the electrophotographic copying machine, creases of 10 mm or shorter have little adverse effects on the image.

The evaluation data tabulated above shows the fact that the formation of the creases on the envelope has a correlation with a difference $\Delta\epsilon$ between the surface strain $\epsilon h$ of the heating roller 10 in the circumferential direction and the surface strain $\epsilon p$ of the pressure roller 20 in the circumferential direction.

Additionally, from the experiment, it is seen that the number of creases formed when the envelope is fed by the horizontal feed is remarkably smaller than that when it is fed by the vertical feed. It is estimated that this is due to the fact that a shift of the upper and lower papers forming the envelope one from the other in a case where the length of the envelope passing through the nip 15 is short is smaller than the case where it is long. This is supported by the fact that the number of creases formed on the longest envelope, Monroe Brand of size 10, when it is fed by the vertical feed, is the largest.

From the above facts, it is seen that if a tolerable level of the envelope crease is O in the horizontal feed, $\Delta\epsilon \leqq 3\%$ (where $\Delta\epsilon = \epsilon h - \epsilon p$)) is preferable.

Further, it is seen that if a tolerable level of the envelope crease is O or higher in the vertical feed, $\Delta\epsilon \leqq 3\%$ (where $\Delta\epsilon = \epsilon h - \epsilon p$)) is preferable.

The self-stripping ability was empirically examined. In this case, a relatively thin and weak, recording paper of 65 g/m$^2$ was used. Color toner was transferred at density of 2.0 mg/cm$^2$ onto the recording paper, to form a non-fixed toner image.

The paper feeding direction was such that the orientation of fibers of the paper was parallel to the heating and pressure rollers 10 and 20. In this paper feeding direction, the paper firmness is insufficient because of its structure, and it is difficult to obtain a sufficient self-stripping ability.

The results of the experiment are shown in FIG. 4 and Table 2.

In FIG. 4, O and X indicate good or no good of the self-stripping ability, and ▯critical values defining a scope of good self-stripping ability.

In Table 2, as in Table 1, the roller construction (including the pressure roller covered with a Teflon layer) for the flat nip corresponded to the conventional one shown in FIG. 7. The depression nip of the heating roller were classified on the basis of the thickness (rubber thickness) of the elastic layer of the pressure roller 20. $\in h$ indicates a strain (corresponding to ▯in FIG. 4) necessary for stripping the paper bearing the molten toner image thereon from the fixing roller interface.

TABLE 2

| | Flat Nip | Depression Nip 1 | 3 | 5 | 7 |
|---|---|---|---|---|---|
| Elastic Layer Thickness of Heating Roller (mm) | 2 | 2 | 2 | 2 | 2 |
| Elastic Layer Thickness of Pressure Roller (mm) | 2 | 1.5 | 1.0 | 0.5 | 0 |
| $\in h$ (%) | 6 | 4 | 3.6 | 3.3 | 3 |
| $\in p$ (%) | 6 | 3 | 1.8 | 0.8 | 0 |
| $\Delta\in$ ($\in h$ - $\in p$) | 0 | 1 | 1.8 | 2.5 | 3 |

From the data, it is seen that as $\Delta\in$ is smaller in the roller construction, $\in h$ must be larger. As $\Delta\in$ is larger in the roller construction, viz., as the nip becomes more flat, it is more difficult to turn the discharging direction of the recording paper to the pressure roller 20 at the exit of the nip, so that the self-stripping ability based on the tendency of turning the discharging direction toward the pressure roller will be lost. To avoid this, the heating roller 10 must have a large surface strain. When the amount of oil to be transferred to the paper is 6 to 10 mg per A4 size by increasing the amount of oil supplied from the oil supplying system, the user's unpleasant feeling by oil when he touches the paper is still present. The image bearing paper is easy to self-strip off the roller interface, and the minimum required value of $\in h$ is reduced. This fact was confirmed by the experiment. However, the values shown in Table 2 ensures a reliable self-stripping-off of the image bearing paper.

The data shown in Table 2 (the critical values obtained by the experiment in FIG. 4 (▯in FIG. 4) was arranged into an approximate expression. The following relation was present between the roller construction expressed by $\Delta\in$ and the surface strain $\in h$ of the heating roller.

$$\in h \geqq 0.0583\,(\Delta\in)^4 - 0.6\,(\Delta\in)^3 + 2.1917(\Delta\in)^2 - 3.65(\Delta\in) + 6$$

where $\Delta\in = \in h - \in p$).

A test was conducted for evaluating the abrasion for the values of $\in h$ in Table 2, by using the above-mentioned fixing unit. In the test results, when $\in h = 6\%$, the abrasion of the surface regions of the elastic layers (deterioration of gloss on the surface regions) was observed at the ends of the elastic layers after the fixing of about 30,000 number of papers. When $\in h$ is 4%, 5%, and 5.5%, no abrasion of the surface regions of the elastic layers was observed even after the fixing of 100,000 number of papers. In the test, the papers each of 65 g/m$_2$ and A4 size were used. A non-fixed toner image was formed on the paper at the image density of 95%, The papers were passed through the nip between the fixing rollers at the speed of 4 sheets of papers per minute. The amount of oil transferred to the paper was 3 mg per area of A4 size.

It is estimated that two factors will cause the bad evaluation result at $\in h = 6\%$.

The first factor is the fact that $\in h$ in the central portion of the heating roller 10 when viewed in the axial direction is 6%, but at the ends thereof it is 7%, larger than in the central portion thereof (Generally, as $\in h$ is larger in the central portion of the heating roller, a difference between the values of $\in h$ in the central portion and at the ends thereof becomes larger.). To prevent creases from being formed on the humidified paper when it passes through the fixing device, the nip width at the ends of the roller must be slightly larger than in the central portion. This brings about $\in h$ of 7% at the ends of the roller. It is for this reason that the abrasion of the surface regions of the elastic layers (deterioration of gloss on the surface regions), which would be due to a slip taking place at the exit of the nip 15 when the strain in the surfaces of the rollers 10 and 20 is removed, tends to occur at the ends of the rollers when viewed in the axial direction.

The second factor is that since the oil supplying system is located closer to the heating roller 10, most of the supplied oils is transferred to the paper 50 when the paper passes through the nip 15, so that a little oil is transferred to the pressure roller 20.

For this reason, the abrasion of the surface regions of the elastic layers (deterioration of gloss on the surface regions) is remarkable on the pressure roller 20.

On the basis of the above data, we reached the conclusion that to prevent the abrasion of the surface regions of the elastic layers, $\in h$ must be $\in h < 6\%$, more preferably $\Delta\in \leqq 5.5\%$.

An area satisfying the expression obtained using the experiment data is shown in FIG. 4. In the figure, an oblique line area is the satisfying area. An approximately 1% is the tolerance of the strain $\in$ in the central portion of the rollers (when viewed in the axial direction) and at the ends thereof.

Variations of the characteristics of the compressed coiled spring and the thickness of the elastic layers additionally add approximately 1% to the tolerance of the strain. For this reason, it is preferable that approximately 2% is allowed for as the strain tolerance in designing the products. A tolerable level of the envelope creases is a preferable level, e.g., at least the level of O in the vertical feed (see Table 1). Particularly the oblique line area defined by a region of $1 \leqq \Delta\in \leqq 2$ is preferable.

The following measuring method was used for measuring the surface strain in the present embodiment.

When a pair of elastic rollers (that are elastic under a certain load) are pressed one against the other under a certain load, the surfaces of the elastic rollers are elastically deformed in the nip area. At this time, the surfaces are strained by a strain quantity $\in$ in the circumferential direction. In this state, the paired rollers are turned and a recording paper is passed through the nip between the rollers. In this case, the paper is moved forward by the strained nip area. The paper length produced when the paper is moved by one turn of the strained elastic rollers is larger than the length of the circumference of the roller by a length defined by the strain $\in$.

Therefore, the strain $\in$(%) can be expressed by $\in$(%)=[{the paper length produced when the paper is moved by one turn of the strained elastic rollers)÷(the length of the circumference of the elastic roller when $\in$=0)}−1]×100.

An actual strain ∈ can be obtained by using the above expression.

As for the roller structure, the fixing rollers (the heating and pressure rollers) 10 and 20 is not limited to the rollers in which the fluororubber layers are formed over the surface layers. For example, a single layer structure in which an HTV silicone rubber or an RTV silicon rubber is formed over the surface of the roller, may be used for the fixing rollers. Where the supply of the amount of oil of 3 mg per area of A4 size, progression of the abrasion of the elastic layers is quick. Therefore, it is necessary to supply the oil of 10 mg or larger or to form a fluoroplastic layer or the combination of a fluoroplastic layer and a fluororubber layer on the surface layer of the roller.

Dimethyl silicone oil may be used for the release agent.

The cleaning member, the oil supplying system, and the like may properly be selected.

A heating source may be provided in the pressure roller 20.

EXAMPLE 1

In the roller construction of FIG. 2, the heating roller 10 includes a hollowed roller 11 as an iron cylindrical member, and an elastic layer 12 of 2 mm thick layered on the surface of the hollowed roller 11. The outside diameter of the hollowed roller 11 is 32 mm, and the inside diameter thereof is 28 mm. The elastic layer 12 is formed with an HTV silicone rubber (40° in rubber hardness) of 2 mm as a primary coat and a fluororubber (60° in rubber hardness) of 30 μm thick dip-coated over the surface of the silicone rubber. The surface of the elastic layer 12 is finished to be on a level with a mirror surface. A halogen lamp 13 of 500 W as a heating source is provided in the hollowed roller 11. Temperature of the surface of the heating roller 10 is controlled to 146° C. by a temperature controller, not shown, when it receives a signal from a temperature sensor, not shown.

Amino modified silicone oil (oil viscosity: 300 CS) with—(CH2)2NH2 as the functional group (b=0.1, c=1, and 30(X-21-7763G), manufactured by Shinetsu Kagaku Corporation in Japan, is used for the release agent. The silicone oil is uniformly supplied to the recording paper 50 at the rate of 3 mg per area of A4 size by an oil supplying system using felt an rubber blade. Additionally, a cleaning web (not shown) using unwoven fabric, as cleaning means, is provided on the surface of the heating roller 10.

The pressure roller 20 includes a hollowed roller 21 as an iron cylindrical member, and an elastic layer 22 of 1.5 mm thick layered on the surface of the hollowed roller 21. The outside diameter of the hollowed roller 21 is 32 mm, and the inside diameter thereof is 28 mm. The elastic layer 22 is formed with an HTV silicone rubber (40° in rubber hardness) of 1.5 mm as a primary coat and a fluororubber (60° in rubber hardness) of 30 μm thick dip-coated over the surface of the silicone rubber. The surface of the elastic layer 22 is finished to be on a level with a mirror surface.

The pressure roller 20 is urged toward the center of the heating roller 10 by a compressed coiled spring (not shown) as a pressure means so that the surface strain of the heating roller 10 is 4%. The load is 36 kg, and the nip width is 4.6 mm. The heating roller 10 was turned at 70 mm/sec by means of drive means (not shown) using a belt, and the pressure roller 20 was turned following the heating roller 10.

A test was conducted for examining the performances of the fixing device of EXAMPLE 1. The test results as given hereinunder were obtained.

The test results on the envelope creases are shown in Table 3.

TABLE 3

| Envelop Creases | | | | | | | |
|---|---|---|---|---|---|---|---|
| Monroe Brand size 10 | | Monroe Brand size Monarch | | River Siries size 110 × 220 mm | | River Siries size 162 × 229 mm | |
| Feeding Direction (a) | Feeding Direction (d) | Feeding Direction (a) | Feeding Direction (d) | Feeding Direction (a) | Feeding Direction (d) | Feeding Direction (a) | Feeding Direction (d) |
| Δ | ○ | Δ | ○ | ○ | ○ | ○ | ○ |

Figure 3A:
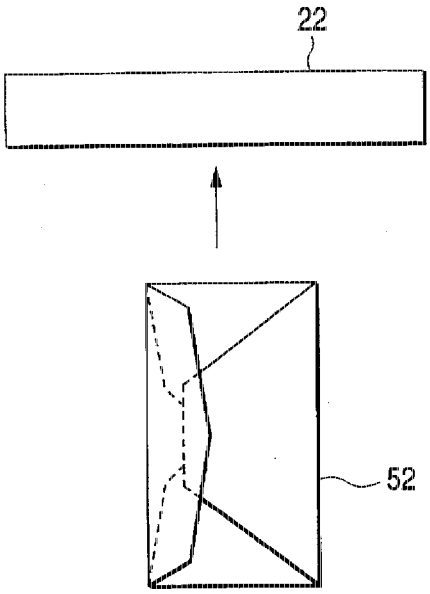
Figure 3B:
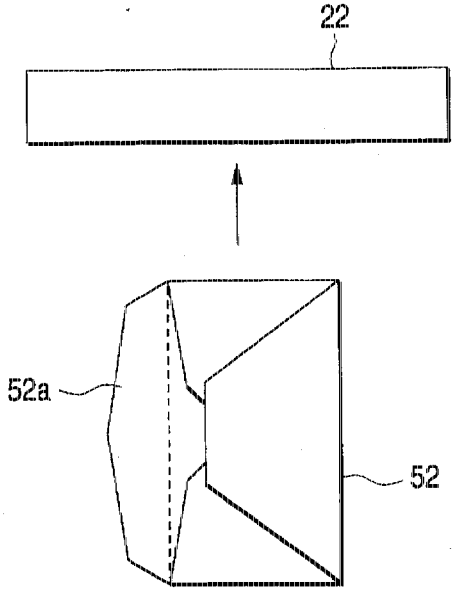
Figure 3C:
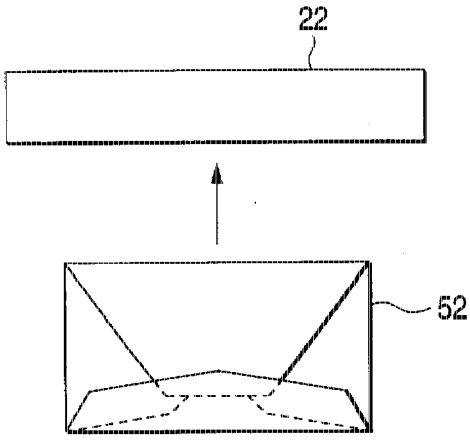
Figure 3D:
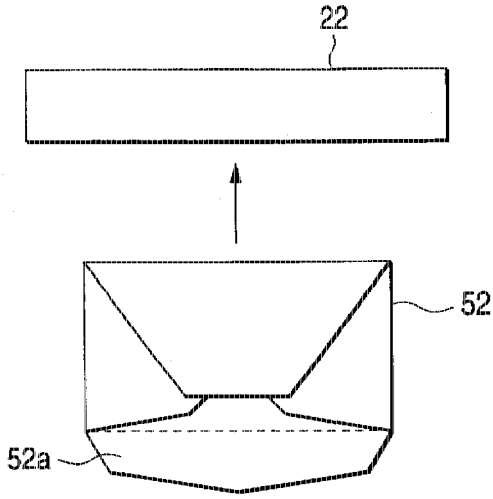

Table 3 shows the presence or absence of creases on the envelops when the envelops are fed in the feeding directions (a) and (b) (corresponding to the feed directions of FIGS. 3*a* and 3*d*). In the table, O indicates that no creases appear on the envelope, Δ, the presence of creases of 5 mm or shorter, and X, the presence of creases of 5 mm or longer. When the envelope of Monroe Brand size e10 was fed in the feeding direction (b) (corresponding to the feed direction of FIG. 3*b*), the creases of Δ appear. When the envelope of Monroe Brand size Monarch was fed in the feeding direction (b) (corresponding to the feed direction of FIG. 3*b*), the creases of O were formed.

An abrasion evaluation test was performed as in the manner described above. In the test, no abrasion was observed on the elastic layers of the rollers and no offset was not observed, and further no adhesion of toner onto the surface of the heating roller 10 was observed after the fixing of 100,000 number of papers.

EXAMPLE 2

The roller construction used in EXAMPLE 2 is substantially the same as in EXAMPLE 1 with some exceptions. In EXAMPLE 2, the hardness of the elastic layers 12 and 22 used was 60° or 70°. The fixing device of EXAMPLE 2 was tested as in EXAMPLE 1. The test results obtained were substantially the same as of EXAMPLE 1. In the test, the rollers were turned at a rotation speed (fixing rate) that is different from that in EXAMPLE 1. The test results were similar to those EXAMPLE 1.

When the hardness of the elastic layers is changed, the nip width is narrowed even if the strain ∈ is adjusted. Therefore, some adjustment of the fixing conditions is required. For example, the surface temperature of the heating roller 10 is adjusted corresponding to the change of the hardness.

EXAMPLE 2 shows that the present invention is valid independently of the hardness of the roller elastic layers and the rotation speed (fixing rate) of the rollers. The fact implies that the surface strain $\epsilon$ in the circumferential direction is uniquely determined only by the geometrical contact of the two rollers.

EXAMPLE 3

The roller construction used in EXAMPLE 3 is substantially the same as in EXAMPLE 1 except that the outside diameters of the rollers 10 and 20, and the thickness of the elastic layers 12 and 22 are X-times as large as those in EXAMPLE 1. The test results were: both $\epsilon h$ and $\epsilon h$ remained unchanged, and the nip width was X-times as large as in EXAMPLE 1, and the load was reduced to 1/X. In this case, a load per unit area in the nip area remained unchanged. The fixing conditions must be adjusted corresponding to a change of the nip width.

EXAMPLE 3 shows that the present invention is valid independently of the roller outside diameter and the thickness of the elastic layers.

EXAMPLE 4

The roller construction used in EXAMPLE 4 is substantially the same as in EXAMPLE 1 except that the thickness of the elastic layers 12 and 22 of the rollers 10 and 20 are X-times as large as in EXAMPLE 1. The test results were: both $\epsilon h$ and $\epsilon h$, the load, and the load per unit area are reduced to 1/X. In this case, the nip width was left unchanged.

EXAMPLE 4 shows that the present invention is valid under the condition that the roller outside diameter is not changed but the thickness of the elastic layers is only changed.

As seen from the foregoing description, the present invention provides an ideal fixing roller construction based on the roller surface strain $\epsilon$ in the circumferential direction. The fixing roller construction succeeds in realizing the satisfactory "self-stripping ability", "envelope crease prevention", and "elastic layer abrasion prevention", which the conventional art cannot realize.

Therefore, the self-stripping of the paper is possible, the crease formation on the envelope is prevented, and the lifetime of the fixing rollers is elongated.

These useful effects of the invention can be obtained under the condition that the amount of the supplied release agent is small.

The useful effects can be obtained for various roller constructions.

What is claimed is:

1. A toner image fixing device comprising first and second toner image fixing rollers rotatable to each other in a state that said rollers are pressed each other; and a heating source contained in one of said fixing rollers; the surfaces of said first and second fixing rollers being covered with elastic layers, respectively, and a recording medium bearing a non-fixed toner image being passed through a nip between said first and second rollers to thereby fix the non-fixed toner image on said recording medium, wherein surface strain $\epsilon h$ in the circumferential direction of the elastic layer of said first roller which comes in contact with the non-fixed toner image on said recording medium, and surface strain $\epsilon p$ in the circumferential direction of the elastic layer of said second fixing roller are defined by:

$$\epsilon h \geqq 0.0583\,(\Delta\epsilon)^4 - 0.6\,(\Delta\epsilon)^3 + 2.1917(\Delta\epsilon)^2 - 3.65(\Delta\epsilon) + 6$$

where $\epsilon h < 6\%$, $\Delta\epsilon \leqq 3\%$ and $\Delta\epsilon = \epsilon h - \epsilon p$.

* * * * *